US012760514B2

(12) United States Patent
Yamaguchi et al.

(10) Patent No.: US 12,760,514 B2
(45) Date of Patent: Oct. 13, 2026

(54) HEAT-INSULATING WATERPROOF STRUCTURE, HEAT-INSULATING WATERPROOF MEMBER, AND METHOD FOR INSTALLING HEAT-INSULATING WATERPROOF STRUCTURE

(71) Applicant: Sekisui House, Ltd., Osaka (JP)

(72) Inventors: Hiroki Yamaguchi, Osaka (JP); Masatoshi Seto, Osaka (JP)

(73) Assignee: Sekisui House, Ltd., Osaka (JP)

( * ) Notice: Subject to any disclaimer, the term of this patent is extended or adjusted under 35 U.S.C. 154(b) by 251 days.

(21) Appl. No.: 18/570,963

(22) PCT Filed: May 16, 2023

(86) PCT No.: PCT/JP2023/018349
§ 371 (c)(1),
(2) Date: Dec. 15, 2023

(87) PCT Pub. No.: WO2024/236746
PCT Pub. Date: Nov. 21, 2024

(65) Prior Publication Data
US 2025/0122721 A1 Apr. 17, 2025

(51) Int. Cl.
*E04B 1/68* (2006.01)
*E04B 1/64* (2006.01)
*E04B 1/76* (2006.01)

(52) U.S. Cl.
CPC ..... *E04B 1/6803* (2013.01); *E04B 1/642* (2013.01); *E04B 1/762* (2013.01)

(58) Field of Classification Search
CPC ..... E04B 1/64; E04B 1/6803; E04B 1/642; E04B 1/762; E02D 27/00
See application file for complete search history.

(56) References Cited

U.S. PATENT DOCUMENTS 5,836,135 A * 11/1998 Hagan ..... E04F 19/02 52/836
10,100,530 B1 * 10/2018 Clark ..... E04F 13/0864
(Continued)

FOREIGN PATENT DOCUMENTS

EP 1 258 573 A1 11/2002
JP S60-70117 U 5/1985
(Continued)

OTHER PUBLICATIONS

Australian Office Action dated Aug. 20, 2025, in connection with Australian Application No. 2023270248.

*Primary Examiner* — Beth A Aubrey
(74) *Attorney, Agent, or Firm* — Wolf, Greenfield & Sacks, P.C.

(57) ABSTRACT

A heat-insulating waterproof structure includes a heat-insulating waterproof member arranged on a building body. The building body includes a foundation and an exterior wall body arranged on the foundation. The exterior wall body includes a metal fitting arranged on the foundation, a column set on the foundation with the metal fitting member located in between, and a backing arranged on the column. The heat-insulating waterproof member includes a heat-insulating member and a waterproof member integrated with the heat-insulating member. The heat-insulating waterproof member is located at an outer side of the exterior wall body along the exterior wall body at a height where the metal fitting is located.

5 Claims, 2 Drawing Sheets

(56) References Cited

U.S. PATENT DOCUMENTS

| | | | | |
|---|---|---|---|---|
| 10,294,667 | B2 * | 5/2019 | Prygon | E04C 2/246 |
| 2025/0290306 | A1 * | 9/2025 | McSheery | E04B 1/167 |

FOREIGN PATENT DOCUMENTS

| | | | |
|---|---|---|---|
| JP | H08-177135 | A | 7/1996 |
| JP | H11-270003 | A | 10/1999 |
| JP | H11-310966 | A | 11/1999 |
| JP | 2000-045401 | A | 2/2000 |
| JP | 2000-336782 | A | 12/2000 |
| JP | 2002-146804 | A | 5/2002 |
| JP | 2005-068791 | A | 3/2005 |
| JP | 2005-068858 | A | 3/2005 |
| JP | 2009-281090 | A | 12/2009 |
| JP | 2012-202187 | A | 10/2012 |
| JP | 2017-172181 | A | 9/2017 |
| JP | 2018-165448 | A | 10/2018 |
| JP | 2020-020234 | A | 2/2020 |

* cited by examiner

HEAT-INSULATING WATERPROOF STRUCTURE, HEAT-INSULATING WATERPROOF MEMBER, AND METHOD FOR INSTALLING HEAT-INSULATING WATERPROOF STRUCTURE

CROSS REFERENCE TO RELATED APPLICATIONS

This Application is a national stage filing under 35 U.S.C. 371 of International Patent Application Serial No. PCT/JP2023/018349, filed May 16, 2023, entitled "HEAT-INSULATING WATERPROOF STRUCTURE, HEAT-INSULATING WATERPROOF MEMBER, AND METHOD FOR INSTALLING HEAT-INSULATING WATERPROOF STRUCTURE." The entire content of this application is incorporated herein by reference in its entirety.

TECHNICAL FIELD

The present disclosure relates to a heat-insulating waterproof structure, a heat-insulating waterproof member, and a method for installing a heat-insulating waterproof structure.

BACKGROUND ART

In a known frame structure of a building, a metal fitting is used to set a column on a foundation (for example, Patent Literature 1). Patent Literature 1 describes that water will condense on such a metal fitting. A structure that uses a heat-insulating member to prevent water condensation near the foundation of a building is also known (for example, Patent Literature 2). In Patent Literature 2, the heat-insulating member is arranged on the outer side of a wall backing.

Further, water may enter a building through a gap near a foundation. Patent Literature 3 discloses a waterproof structure of a building that fills a gap between a base, which is arranged on the side surface of a foundation, and a cladding. In Patent Literature 3, a waterproof member (sealing member in Patent Literature 3) is arranged in the gap between the base and the cladding.

CITATION LIST

Patent Literature

Patent Literature 1: Japanese Laid-Open Patent Publication No. 2005-068858

Patent Literature 2: Japanese Laid-Open Patent Publication No. 11-270003

Patent Literature 3: Japanese Laid-Open Patent Publication No. 2012-202187

SUMMARY OF INVENTION

Technical Problem

In a building, when a column is set on the foundation with a metal fitting, a heat-insulating member, which prevents water condensation, is arranged on the metal fitting. Further, a waterproof member is arranged near the foundation of the building. In this manner, multiple members such as a heat-insulating material, a waterproof material, and the like need to be installed near the foundation of the building.

It is an objective of the present disclosure to provide a heat-insulating waterproof structure of a building, a heat-insulating waterproof member used for the heat-insulating waterproof structure, and a method for installing the heat-insulating waterproof structure, that improve efficiency when a building is constructed.

Solution to Problem (1) A heat-insulating waterproof structure of a building, the heat-insulating waterproof structure including a heat-insulating waterproof member arranged on a building body. The building body includes a foundation and an exterior wall body arranged on the foundation. The exterior wall body includes a metal fitting arranged on the foundation, a column set on the foundation with the metal fitting member located in between, and a backing arranged on the column. The heat-insulating waterproof member includes a heat-insulating member and a waterproof member integrated with the heat-insulating member, the heat-insulating waterproof member being located at an outer side of the exterior wall body along the exterior wall body at a height where the metal fitting is located. With this structure, the heat-insulating member and the waterproof member are integrated. Thus, the heat-insulating member and the waterproof member are attached to the exterior wall body through less installation steps than when separately setting the heat-insulating member and the waterproof member. The heat-insulating member and the waterproof member are attached to the exterior wall body in a preferred manner. Thus, the heat-insulating waterproof structure improves efficiency when the building is constructed.

(2) The heat-insulating waterproof structure in (1), where the waterproof member is located closer to the foundation than the heat-insulating member is. With this structure, the waterproof member easily contacts the foundation and closes a gap between the foundation and the heat-insulating member in a preferred manner. Thus, the heat-insulating waterproof member is arranged on the exterior wall body in a preferred manner so that the waterproof member will fill a gap between the foundation and the heat-insulating member.

(3) The heat-insulating waterproof structure in (1) or (2), where the heat-insulating waterproof member includes an auxiliary member, and the auxiliary member includes a first portion that is attached to the heat-insulating member and the waterproof member and a second portion that is arranged along the heat-insulating member. With this structure, the first portion of the auxiliary member integrates the heat-insulating member and the waterproof member in a preferred manner. Further, the second portion of the auxiliary member, which extends along the heat-insulating member, limits deformation of the heat-insulating member when the heat-insulating waterproof member is arranged on the building body.

(4) The heat-insulating waterproof structure in any one of (1) to (3), where the building body further includes a flashing member arranged between the foundation and the backing in a height direction and a waterproof sheet arranged on an outer surface of the backing. The heat-insulating waterproof member is arranged below a lower surface of the backing. The flashing member is fixed to an outer surface of the heat-insulating waterproof member. The waterproof sheet includes a lower end portion that covers an upper end portion of the flashing member. With this structure, water on the waterproof sheet is guided to the flashing member in a preferred manner, and the drainage capabilities of the building are improved.

(5) The heat-insulating waterproof structure in (4), where the heat-insulating waterproof member further includes a fixing member that fixes the lower end portion of the waterproof sheet to the upper end portion of the flashing member. The fixing member includes a bonding portion bonded to the lower end portion of the waterproof sheet, and the fixing member is integrated with the waterproof member and the heat-insulating member. With this structure, the fixing member bonds the lower end portion of the waterproof sheet to the heat-insulating waterproof member and fixes the flashing member to the outer surface of the heat-insulating waterproof member. Thus, water does not enter a gap between the waterproof sheet and the flashing member.

(6) A heat-insulating waterproof member used in a heat-insulating waterproof structure of a building, the heat-insulating waterproof member including a heat-insulating member and a waterproof member integrated with the heat-insulating member. The heat-insulating member has a form of a tape and is arranged along a lower end portion of an exterior wall body of the building. The waterproof member is arranged along a lower end of the heat-insulating member. This structure integrates the heat-insulating member and the waterproof member. The number of installation steps of attaching the heat-insulating member and the waterproof member to the exterior wall body is reduced. Further, the heat-insulating member has the form of a tape, and the waterproof member is arranged along the lower end of the heat-insulating member. Thus, the heat-insulating waterproof member can be easily set along the exterior wall body of the building. The heat-insulating member and the waterproof member are attached to the exterior wall body in a preferred manner. Thus, the heat-insulating waterproof structure can improve efficiency when the building is constructed.

(7) A method for installing a heat-insulating waterproof structure that is arranged on a building body, the building body including a foundation and an exterior wall body arranged on the foundation. The exterior wall body includes a metal fitting arranged on the foundation, a column set on the foundation with the metal fitting located in between, and a backing arranged on the column. The method includes providing the heat-insulating waterproof structure with a heat-insulating waterproof member. The heat-insulating waterproof member includes a heat-insulating member and a waterproof member integrated with the heat-insulating member. The providing the heat-insulating waterproof structure includes arranging the heat-insulating waterproof member between the foundation and a lower surface of the backing of the exterior wall body so that the waterproof member contacts the foundation without forming a gap between the heat-insulating member and the foundation. With this structure, the heat-insulating member and the waterproof member are simultaneously set on the exterior wall body. This reduces the number of operations performed when the building is constructed. Thus, the method for installing the heat-insulating waterproof structure improves efficiency when the building is constructed.

Advantageous Effects of Invention

The heat-insulating waterproof structure, the heat-insulating waterproof member, and the method for installing a heat-insulating waterproof structure of the present disclosure improve efficiency when a building is constructed.

DESCRIPTION OF EMBODIMENTS

Embodiment

A heat-insulating waterproof structure 20, a heat-insulating waterproof member 30, and a method for installing the heat-insulating waterproof structure 20 according to one embodiment will now be described with reference to FIGS. 1 to 3.

Building

Figure 1:
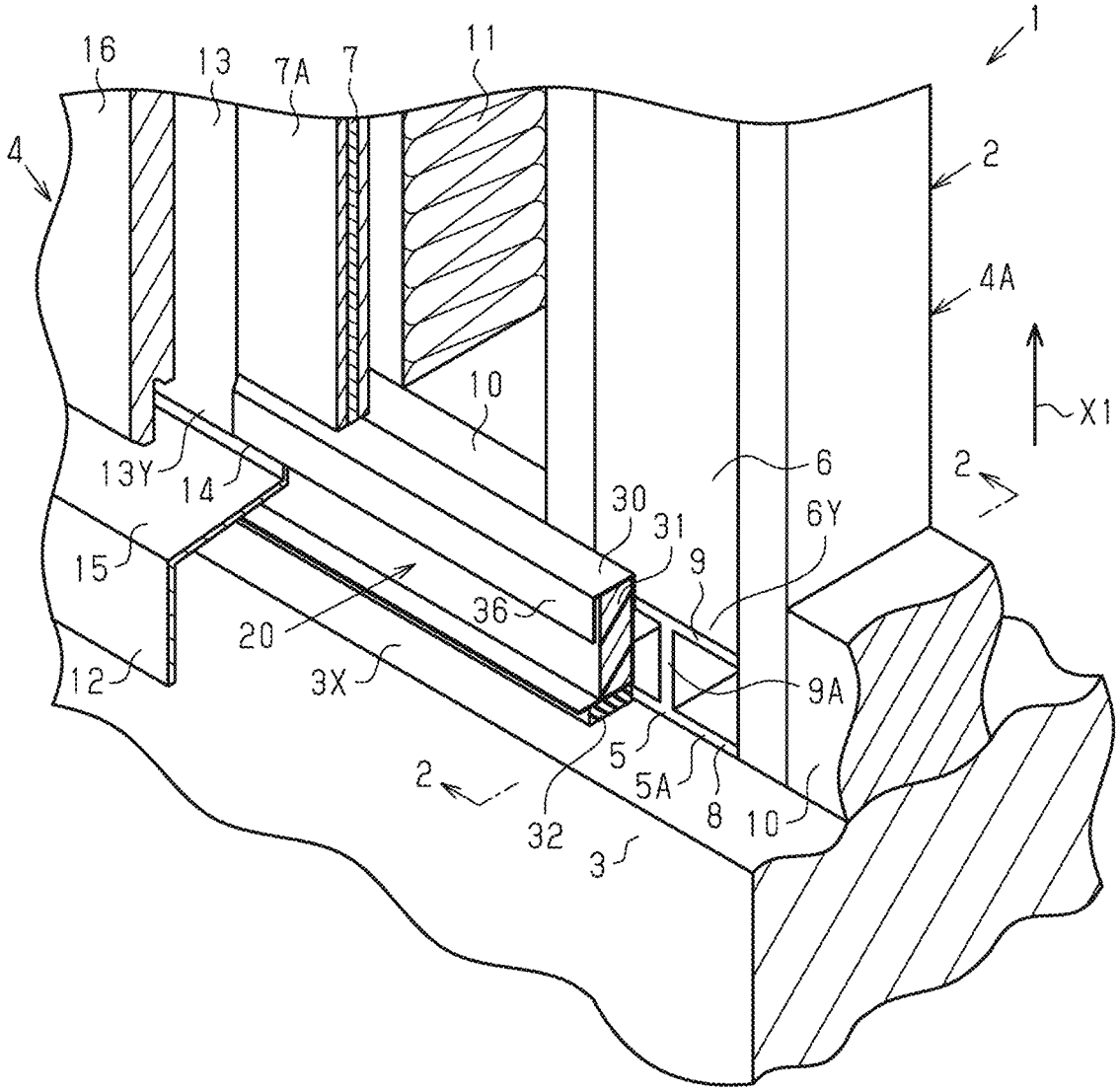
FIG. 1 is a perspective view showing the structure of a building according to one embodiment of the present disclosure.

As shown in FIG. 1, a building 1 includes a building body 2. Examples of the building 1 include a house, a stand-alone office, a medical facility, and the like. The building body 2 includes a foundation 3 and an exterior wall 4 arranged on the foundation 3. The exterior wall 4 includes an exterior wall body 4A. The foundation 3 is formed from, for example, reinforced concrete. The exterior wall body 4A is arranged on the foundation 3. The building 1 further includes a roof that covers the indoor space defined by the exterior wall body 4A.

The exterior wall body 4A includes a metal fitting 5 arranged on the foundation 3, a column 6 set on the foundation 3 with the metal fitting 5 located in between, and a backing 7 arranged on the column 6. The metal fitting 5 is placed on an upper surface 3X of the foundation 3. The metal fitting 5 joins the column 6 to the foundation 3. The metal fitting 5 includes a base plate 8 placed on the upper surface 3X of the foundation 3, a bearing plate 9 that receives a lower end 6Y of the column 6, a connection plate 9A that connects the base plate 8 to the bearing plate 9, and an insertion plate (not shown) vertically extending from the bearing plate 9. The base plate 8 is joined to the foundation 3 by, for example, anchor bolts. The bearing plate 9 is supported above the base plate 8 by the connection plate 9A. The connection plate 9A may have any shape as long as the connection plate 9A can support the bearing plate 9 above the base plate 8. The insertion plate of the metal fitting 5 is arranged on the bearing plate 9 and inserted into a slit of the column 6. The insertion plate of the metal fitting 5 is coupled to the column 6 by drift pins in a state inserted into the slit of the column 6. The column 6 is formed from, for example, wood or steel. The backing 7 is arranged on the side surface of the column 6. Examples of the backing 7 include structural plywood, a plaster board, and the like.

The exterior wall body 4A includes a lower frame 10 connected to the column 6. The lower frame 10 is set on the upper surface 3X of the foundation 3. The outer surface of the lower frame 10 is flush with the outer surface of the column 6.

The exterior wall body 4A includes an exterior wall heat-insulating member 11 arranged above the lower frame 10. The exterior wall heat-insulating member 11 is arranged on the exterior wall body 4A to maintain the room temperature of the building 1. The exterior wall heat-insulating member 11 is arranged in a space surrounded by the columns 6 and the lower frame 10. The exterior wall heat-insulating member 11 may be formed from, for example, a glass wool heat-insulating material. The exterior wall body 4A includes, for example, another column 6 arranged parallel to the column 6. The lower frame 10 and the exterior wall heat-insulating member 11 are arranged between the column 6 and the other column 6.

The building body 2 further includes a flashing member 12, which is arranged between the foundation 3 and the backing 7 in a height direction X1, and a waterproof sheet 13, which is arranged on an outer surface 7A of the backing 7. The flashing member 12 guides water from the exterior wall body 4A to the ground so that the water does not flow on the upper surface 3X of the foundation 3. The flashing member 12 includes a flashing attachment portion 14, which is attached to a heat-insulating waterproof member 30 that will be described later, and a flashing portion 15, which extends from the flashing attachment portion 14. The flashing portion 15 extends from near the lower end of the backing 7 and covers the upper part of the outer surface of the foundation 3 when the flashing member 12 is attached near the lower end of the backing 7. The waterproof sheet 13 is attached to the outer surface of the backing 7 so that water does not enter the backing 7. The waterproof sheet 13 is arranged between the backing 7 and a cladding 16.

The waterproof sheet 13 includes a lower end portion 13Y that covers an upper end portion 12X of the flashing member 12. The upper end portion 12X of the flashing member 12 includes, for example, the flashing attachment portion 14 of the flashing member 12. The lower end portion 13Y of the waterproof sheet 13 covers the upper end portion 12X of the flashing member 12 so that water flows on the waterproof sheet 13 to the flashing portion 15 of the flashing member 12 (refer to FIG. 2).

The cladding 16 forming the outer surface of the building body 2 is arranged on the exterior wall body 4A. The cladding 16 is arranged toward the outer side of the building 1 from the backing 7. FIG. 1 shows, in part, the cross section of the structures of the backing 7, the lower frame 10, the exterior wall heat-insulating member 11, the flashing member 12, the waterproof sheet 13, and the cladding 16.

Heat-Insulating Waterproof Structure

The building 1 includes a heat-insulating waterproof structure 20. The heat-insulating waterproof structure 20 is arranged on the building body 2 to improve the heat insulation property and the waterproof property of the building 1. The heat-insulating waterproof structure 20 covers at least part of the exterior wall body 4A. In the present embodiment, the heat-insulating waterproof structure 20 covers the outer sides of the metal fitting 5 and the lower frame 10.

Heat-Insulating Waterproof Member

The heat-insulating waterproof structure 20 includes a heat-insulating waterproof member 30 arranged on the building body 2. The heat-insulating waterproof member 30 is used for the heat-insulating waterproof structure 20 of the building 1. The heat-insulating waterproof member 30 is arranged on the outer side of the exterior wall body 4A along the exterior wall body 4A at the height where the metal fitting 5 is located. The heat-insulating waterproof member 30 is overlapped with the metal fitting 5 and the lower frame 10 in the horizontal direction. The heat-insulating waterproof member 30 is overlapped with the lower end 6Y of the column 6 in the horizontal direction. The heat-insulating waterproof member 30 is, for example, fastened by nails to the lower frame 10 and attached to the outer side of the exterior wall body 4A.

Figure 2:
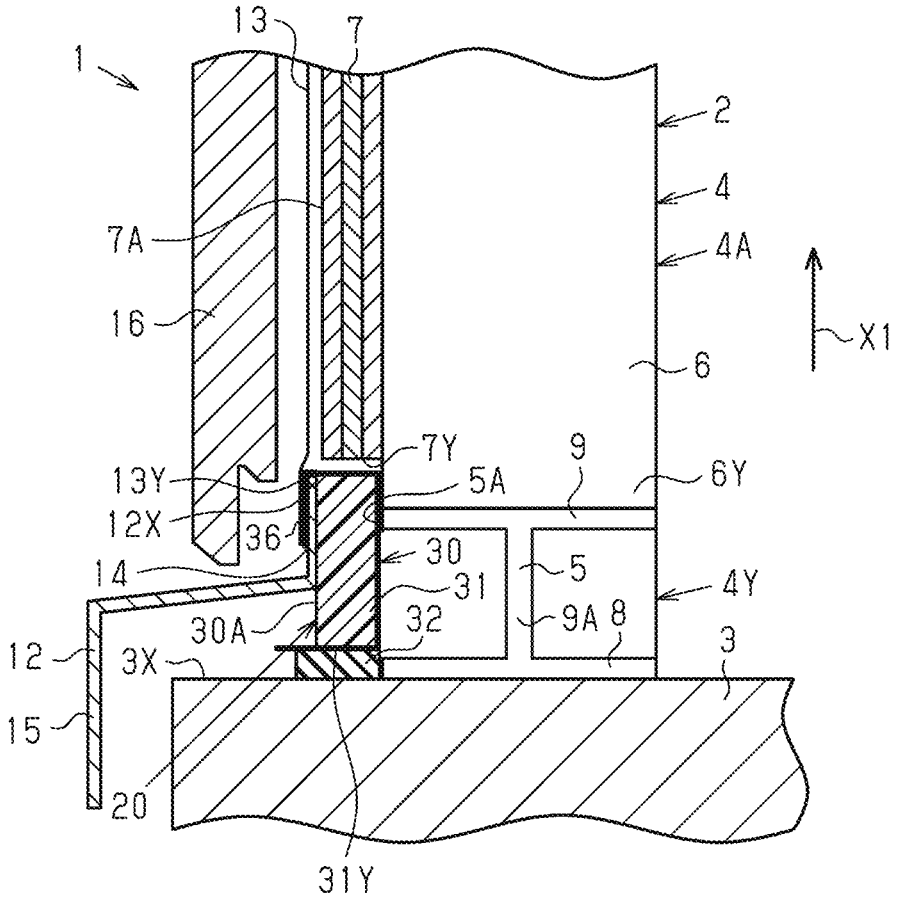
FIG. 2 is a cross-sectional view taken along line 2-2 in FIG. 1.

As shown in FIG. 2, the heat-insulating waterproof member 30 is arranged below a lower surface 7Y of the backing 7. The heat-insulating waterproof member 30 is arranged between the lower surface 7Y of the backing 7 and the upper surface 3X of the foundation 3 in the height direction X1.

Figure 3:
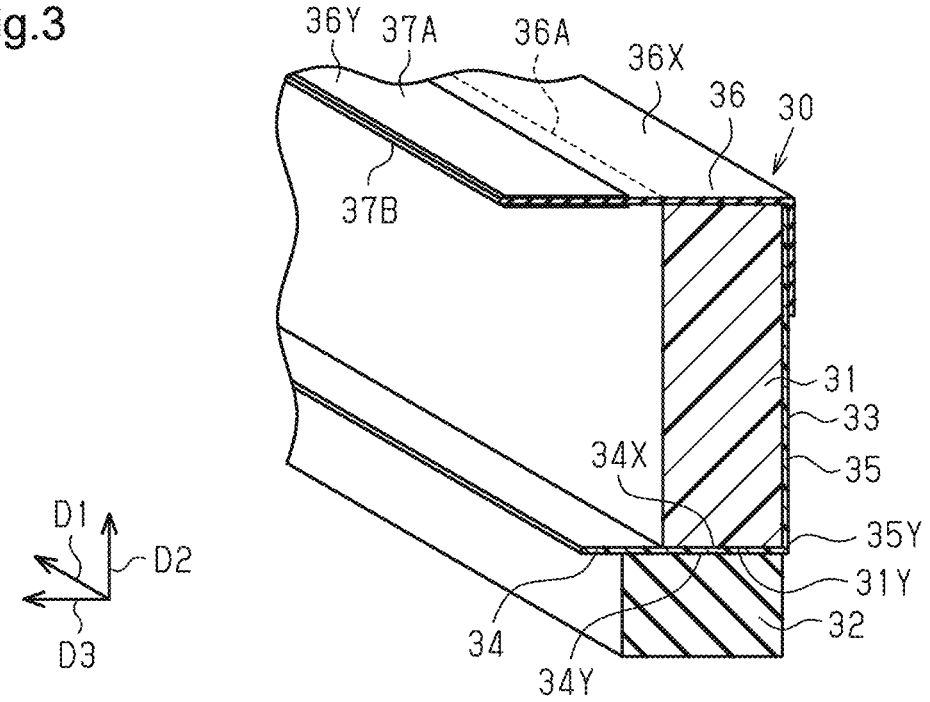
FIG. 3 is a perspective view of a heat-insulating waterproof member.

As shown in FIG. 3, the heat-insulating waterproof member 30 includes a heat-insulating member 31 and a waterproof member 32. The waterproof member 32 is integrated with the heat-insulating member 31. The heat-insulating waterproof member 30 extends in a first direction D1. The first direction D1 coincides with the direction in which the exterior wall body 4A extends in plan view when the heat-insulating waterproof member 30 is arranged on the building body 2 (refer to FIG. 1). The length of the heat-insulating waterproof member 30 in the first direction D1 varies in accordance with the structure of the exterior wall body 4A. The waterproof member 32 and the heat-insulating member 31 are integrated to be aligned in a second direction D2 that is perpendicular to the first direction D1. The second direction D2 coincides with the height direction X1 when the heat-insulating waterproof member 30 is arranged on the building body 2 (refer to FIG. 2).

As shown in FIG. 2, the heat-insulating member 31 is arranged along the metal fitting 5 and the lower frame 10. The heat-insulating member 31 covers at least part of an outer surface 5A of the metal fitting 5. The outer surface 5A of the metal fitting 5 is a surface of the metal fitting 5 that faces the outer side of the building 1. The heat-insulating member 31 may contact a side surface of the bearing plate 9 of the metal fitting 5. The heat-insulating member 31 is formed from, for example, a material such as urethane foam, polystyrene foam, or the like.

The waterproof member 32 is arranged below the heat-insulating member 31. The waterproof member 32 is located closer to the foundation 3 than the heat-insulating member 31 is. The waterproof member 32 is arranged between the heat-insulating member 31 and the foundation 3. The waterproof member 32 is arranged on the upper surface 3X of the foundation 3 to close the gap between the heat-insulating member 31 and the upper surface 3X of the foundation 3 when the heat-insulating waterproof member 30 is attached to the exterior wall body 4A. The waterproof member 32 may be in contact with the base plate 8 of the metal fitting 5. The waterproof member 32 is formed from, for example, a material such as ethylene propylene rubber (EPT), silicone rubber, natural rubber, or the like.

The heat-insulating member 31 has the form of a tape and is arranged along a lower end portion 4Y of the exterior wall body 4A of the building 1. The waterproof member 32 is arranged along a lower end 31Y of the heat-insulating member 31. The waterproof member 32 is smaller in size than the heat-insulating member 31 in the height direction X1. The heat-insulating member 31 and the waterproof member 32 are integrated so that surfaces facing the metal fitting 5 and the lower frame 10 are flush with each other. The waterproof member 32 is greater in thickness in a third direction D3 (refer to FIG. 3) than the heat-insulating member 31. The third direction D3 is perpendicular to the first direction D1 and the second direction D2.

As shown in FIG. 3, the heat-insulating waterproof member 30 includes an auxiliary member 33. The auxiliary member 33 is integrated with the heat-insulating member 31 and the waterproof member 32. The auxiliary member 33 is formed from a material harder than that of the heat-insulating member 31. The auxiliary member 33 is formed from resin. The auxiliary member 33 is formed from, for example, a material such as polypropylene (PP), polyethylene (PE), or the like.

The auxiliary member 33 includes a first portion 34, attached to the heat-insulating member 31 and the waterproof member 32, and a second portion 35, which is arranged along the heat-insulating member 31. The first portion 34 has the form of a plate that is perpendicular to the second direction D2. The first portion 34 includes an upper surface 34X, bonded to the heat-insulating member 31, and a lower surface 34Y, bonded to the waterproof member 32. The heat-insulating member 31 and the waterproof member 32 are integrated when bonded to the first portion 34. The dimension of the first portion 34 in the third direction D3 is greater than or equal to that of the waterproof member 32.

The second portion 35 of the auxiliary member 33 has the form of a plate that is perpendicular to the third direction D3. The second portion 35 is arranged along the heat-insulating member 31. The second portion 35 may be bonded to the heat-insulating member 31. The second portion 35 is located between the metal fitting 5 and the lower frame 10 and the heat-insulating member 31 (refer to FIG. 2). The second portion 35 includes a lower end portion 35Y in the second direction D2 that is connected to the first portion 34. The second portion 35 is formed integrally with the first portion 34.

As shown in FIG. 2, the heat-insulating waterproof member 30 further includes a fixing member 36. The fixing member 36 fixes the lower end portion 13Y of the waterproof sheet 13 to the upper end portion 12X of the flashing member 12. The fixing member 36 has the form of a sheet. One example of the fixing member 36 is a rubber sheet. The fixing member 36 is arranged to cover the upper ends of the heat-insulating member 31 and the auxiliary member 33.

As shown in FIG. 3, the fixing member 36 is integrated with the waterproof member 32 and the heat-insulating member 31. The fixing member 36 includes an attachment portion 36X and an extension portion 36Y extending from the attachment portion 36X. The fixing member 36 is integrated with the waterproof member 32 and the heat-insulating member 31 when the attachment portion 36X is bonded to the auxiliary member 33. The fixing member 36 may be bonded to the heat-insulating member 31.

The fixing member 36 includes a bonding portion 37A bonded to the lower end portion 13Y of the waterproof sheet 13 (refer to FIG. 2). The fixing member 36 further includes an additional bonding portion 37B bonded to the outer surface of the upper end portion 12X of the flashing member 12. The bonding portion 37A and the additional bonding portion 37B are arranged on the extension portion 36Y. The bonding portion 37A is arranged on one surface of the extension portion 36Y. The additional bonding portion 37B is arranged on the other surface of the extension portion 36Y at the opposite side of the bonding portion 37A. The bonding portion 37A and the additional bonding portion 37B are, for example, adhesive tape. The extension portion 36Y is arranged on the outer side of the upper end portion 12X of the flashing member 12 and on the inner side of the lower end portion 13Y of the waterproof sheet 13. The additional bonding portion 37B of the extension portion 36Y is bonded to the upper end portion 12X of the flashing member 12, and the lower end portion 13Y of the waterproof sheet 13 is bonded to the bonding portion 37A. Thus, the waterproof sheet 13 restricts the entry of water through the gap between the backing 7 and the heat-insulating member 31.

The flashing member 12 is fixed to an outer surface 30A of the heat-insulating waterproof member 30. The flashing member 12 is, for example, fastened by nails to the outer surface 30A of the heat-insulating waterproof member 30. The fixing member 36 is bent along a broken line 36A of FIG. 3 toward the heat-insulating member 31 so that the additional bonding portion 37B is bonded to the upper end portion 12X of the flashing member 12, which is fastened by nails to the heat-insulating member 31.

Method for Installing Heat-Insulating Waterproof Structure

A method for installing the heat-insulating waterproof structure 20 on the building body 2 will now be described with reference to FIGS. 1 to 3.

The method includes a first step of setting the heat-insulating waterproof structure 20 with the heat-insulating waterproof member 30. The method further includes a second step of attaching the flashing member 12 and the waterproof sheet 13 to the heat-insulating waterproof member 30.

In the first step, the heat-insulating waterproof member 30 is arranged between the foundation 3 and the lower surface 7Y of the backing 7 of the exterior wall body 4A so that the waterproof member 32 contacts the foundation 3 and that a gap will not form between the heat-insulating member 31 and the foundation 3. Specifically, the heat-insulating waterproof member 30 is pressed from above so that the waterproof member 32 comes into contact with the foundation 3. In a state in which the waterproof member 32 is in contact with the foundation 3 is this manner, the heat-insulating member 31 of the heat-insulating waterproof member 30 is fastened by nails to the lower frame 10. Thus, the waterproof member 32 contacts the foundation 3 and fills the gap between the foundation 3 and the heat-insulating member 31. The heat-insulating waterproof structure 20 is arranged on the building body 2 in this manner. Alternatively, the heat-insulating member 31 of the heat-insulating waterproof member 30 is fastened by nails to the lower frame 10. Then, the waterproof member 32 is pressed toward the foundation 3 so that the waterproof member 32 closes the gap between the foundation 3 and the heat-insulating member 31. The heat-insulating waterproof structure 20 may be arranged on the building body 2 in this manner.

In the second step, the flashing member 12 is attached to the heat-insulating waterproof member 30 by fastening the flashing attachment portion 14 of the flashing member 12 with nails to the heat-insulating member 31 of the heat-insulating waterproof member 30. After fastening the flashing member 12 with nails to the heat-insulating member 31, the fixing member 36 of the heat-insulating waterproof member 30 is bent along the broken line 36A so that the additional bonding portion 37B of the fixing member 36 is bonded to the flashing attachment portion 14 of the flashing member 12. Then, the waterproof sheet 13 is bonded to the bonding portion 37A of the fixing member 36 of the heat-insulating waterproof member 30.

Operation

The operation of the present embodiment will now be described.

When a metal fitting extending from the outer surface to the inner surface of the exterior wall body 4A is arranged on the exterior wall 4, water condensation will easily occur when the metal fitting is cooled by the outside air. This may cause corrosion of the metal fitting, decay of members in the periphery of the metal fitting, or contamination of the metal fitting. Further, the metal fitting extending from the outer surface to the inner surface of the exterior wall body 4A serves as a thermal bridge that transfers heat between the outside and the inside of the room. When the outdoor temperature is lower than the room temperature, the metal fitting cooled by the outside air may lower the room temperature and affect indoor comfort. When a heat-insulating member is arranged on the outer side of the exterior wall body 4A and a gap exists between the heat-insulating member and the foundation, water will enter the gap. This may corrode the metal fitting, decay the lower frame 10, or cause indoor contamination. Water includes rainwater, muddy water, and water used for cleaning the building 1.

Thus, a heat-insulating member and a waterproof member are arranged around the foundation of the building 1.

With the heat-insulating waterproof structure 20 of the present embodiment, the heat-insulating member 31 of the heat-insulating waterproof member 30 covers the outer surface 5A of the metal fitting 5. Thus, the metal fitting 5 is less affected by the outdoor temperature. This avoids the condensation of water on the metal fitting 5 and limits decreases in the room temperature caused by the metal fitting 5. Further, the waterproof member 32 of the heat-insulating waterproof member 30 closes the gap between the heat-insulating member 31 and the foundation 3. This restricts the entrance of water through the gap between the heat-insulating member 31 and the foundation 3.

The heat-insulating waterproof structure 20 of the present embodiment further has the following features. In the heat-insulating waterproof member 30, the heat-insulating member 31 and the waterproof member 32 are formed integrally. This structure limits the formation of a gap between the heat-insulating member 31 and the waterproof member 32. The upper part of the heat-insulating member 31 is fixed to the lower frame 10. The exterior wall heat-insulating member 11 is arranged above the lower frame 10. The lower part of the waterproof member 32 contacts the foundation 3. Such a structure forms a heat-insulating layer, extending continuously from the foundation 3 to the exterior wall heat-insulating member 11, on the outer side of the metal fitting 5. The heat-insulating layer is formed by the heat-insulating member 31. With such a heat-insulating layer, the metal fitting 5 will entirely be in a temperature environment similar to that at the indoor side. This eliminates a difference in temperature between the outer side and the inner side of the metal fitting 5. Thus, the occurrence of water condensation on the surface of the metal fitting 5 will be limited regardless of seasons including spring, summer, the rainy season, fall, winter, and the like.

With the heat-insulating waterproof structure 20 of the present embodiment, the heat-insulating member 31 and the waterproof member 32 are integrated in the heat-insulating waterproof member 30. Thus, the heat-insulating member 31 and the waterproof member 32 are simultaneously set on the exterior wall body 4A when installed. Further, the heat-insulating waterproof member 30, extending in the first direction D1, is easily set along the metal fitting 5 and the lower frame 10 when the heat-insulating waterproof member 30 is arranged on the exterior wall body 4A.

The first portion 34 of the auxiliary member 33, which has the form of a plate, is bonded to the heat-insulating member 31 and the waterproof member 32 to integrate the heat-insulating member 31 and the waterproof member 32. This limits the formation of a gap between the heat-insulating member 31 and the waterproof member 32. Thus, the outside air, water, or the like does not enter a gap between the heat-insulating member 31 and the waterproof member 32.

With the heat-insulating waterproof structure 20, in the fixing member 36 of the heat-insulating waterproof member 30, the bonding portion 37A is bonded to the lower end portion 13Y of the waterproof sheet 13, and the additional bonding portion 37B is bonded to the upper end portion 12X of the flashing member 12. In this manner, the flashing member 12 and the waterproof sheet 13 are arranged so that the lower end portion 13Y of the waterproof sheet 13 covers the upper end portion 12X of the flashing member 12. Since no gap is formed between the waterproof sheet 13 and the flashing member 12 in the height direction X1, water on the waterproof sheet 13 easily flows to the flashing member 12. With such a structure, the waterproof sheet 13 and the flashing member 12 guide water from the exterior wall body 4A to the ground in a preferred manner, and entrance of water into the building 1 will be limited.

In the first step of the method for installing the heat-insulating waterproof structure 20, when setting the heat-insulating waterproof member 30, one will press or stretch the heat-insulating waterproof member 30. This may deform the heat-insulating member 31. Further, when nails are driven into the heat-insulating member 31 to attach the heat-insulating waterproof member 30 to the exterior wall body 4A, the nails may move the heat-insulating member 31 and crack the heat-insulating member 31. In this respect, with the heat-insulating waterproof member 30 of the present embodiment, the second portion 35 of the auxiliary member 33 is arranged along the heat-insulating member 31. This limits deformation, cracking, and the like of the heat-insulating member 31 when installed. For example, even when the heat-insulating waterproof member 30 is pressed or stretched in the first step, the second portion 35 is formed from a material harder than that of the heat-insulating member 31. This will limit bending, contraction, or the like of the heat-insulating member 31. Thus, the waterproof member 32 is attached to the foundation 3 in a preferred manner, and the waterproof member 32 will be in contact with the foundation 3. Further, when nails are driven into the heat-insulating member 31, the nails are also driven into the second portion 35, which is harder than the heat-insulating member 31. Thus, movement of the heat-insulating member 31 will be limited when driving in the nails. Even if the heat-insulating member 31 were to be moved, cracking and the like of the heat-insulating member 31 will be limited.

Advantages

The present embodiment has the following advantages.

(1) The heat-insulating waterproof structure 20 includes the heat-insulating waterproof member 30. The heat-insulating waterproof member 30 includes the heat-insulating member 31 and the waterproof member 32 integrated with the heat-insulating member 31. The heat-insulating waterproof member 30 is arranged on the outer side of the exterior wall body 4A along the exterior wall body 4A at the height where the metal fitting 5 is located. With this structure, the heat-insulating member 31 and the waterproof member 32 are integrated. This allows the heat-insulating member 31 and the waterproof member 32 to be simultaneously set on the exterior wall body 4A. Thus, the heat-insulating member 31 and the waterproof member 32 are attached to the exterior wall body 4A through less installation steps than when separately setting the heat-insulating member 31 and the waterproof member 32. The heat-insulating member 31 and the waterproof member 32 are attached to the exterior wall body 4A in a preferred manner. This improves efficiency when the building 1 is constructed.

(2) The waterproof member 32 is located closer to the foundation 3 than the heat-insulating member 31 is. With this structure, the waterproof member 32 easily contacts the foundation 3 and closes a gap between the foundation 3 and the heat-insulating member 31 in a preferred manner. Thus, the heat-insulating waterproof member 30 is arranged on the exterior wall body 4A in a preferred manner so that the waterproof member 32 will fill a gap between the foundation 3 and the heat-insulating member 31.

(3) The auxiliary member 33 includes the first portion 34, which is attached to the heat-insulating member 31 and the waterproof member 32, and the second portion 35, which is arranged along the heat-insulating member 31. With this structure, the first portion 34 of the auxiliary member 33 integrates the heat-insulating member 31 and the waterproof member 32 in a preferred manner. Further, the second portion 35 of the auxiliary member 33, which extends along the heat-insulating member 31, limits deformation of the heat-insulating member 31 when the heat-insulating waterproof member 30 is arranged on the building body 2.

(4) The heat-insulating waterproof member 30 is arranged below the lower surface 7Y of the backing 7. The flashing member 12 is fixed to the outer surface 30A of the heat-insulating waterproof member 30. The lower end portion 13Y of the waterproof sheet 13 covers the upper end portion 12X of the flashing member 12. With this structure, water on the waterproof sheet 13 is guided to the flashing member 12 in a preferred manner, and the drainage capabilities of the building 1 are improved.

(5) The heat-insulating waterproof member 30 further includes the fixing member 36 that fixes the lower end portion 13Y of the waterproof sheet 13 to the upper end portion 12X of the flashing member 12. The fixing member 36 includes the bonding portion 37A bonded to the lower end portion 13Y of the waterproof sheet 13. The fixing member 36 is integrated with the waterproof member 32 and the heat-insulating member 31. With this structure, the fixing member 36 bonds the lower end portion 13Y of the waterproof sheet 13 to the heat-insulating waterproof member 30 and fixes the flashing member 12 to the outer surface 30A of the heat-insulating waterproof member 30. Thus, water does not enter a gap between the waterproof sheet 13 and the flashing member 12. Since the fixing member 36 bonds the waterproof sheet 13 and the flashing member 12 in this manner and the drainage capabilities are improved, water does not flow through a gap extending from the metal fitting 5 and the lower frame 10 to the foundation 3.

(6) The heat-insulating waterproof member 30 includes the heat-insulating member 31 and the waterproof member 32 integrated with the heat-insulating member 31. The heat-insulating member 31, which has the form of a tape, is arranged along the lower end portion 4Y of the exterior wall body 4A of the building 1. The waterproof member 32 is arranged along the lower end 31Y of the heat-insulating member 31. This structure integrates the heat-insulating member 31 and the waterproof member 32. The number of installation steps of attaching the heat-insulating member 31 and the waterproof member 32 to the exterior wall body 4A is reduced. Further, the heat-insulating member 31 has the form of a tape, and the waterproof member 32 is arranged along the lower end 31Y of the heat-insulating member 31. Thus, the heat-insulating waterproof member 30 can be easily set along the exterior wall body 4A of the building 1. The heat-insulating member 31 and the waterproof member 32 are attached to the exterior wall body 4A in a preferred manner. Thus, the heat-insulating waterproof structure 20 can improve efficiency when the building 1 is constructed.

(7) The method for installing the heat-insulating waterproof structure 20 includes the first step of setting the heat-insulating waterproof structure 20 with the heat-insulating waterproof member 30. In the first step, the heat-insulating waterproof member 30 is arranged between the foundation 3 and the lower surface 7Y of the backing 7 of the exterior wall body 4A so that the waterproof member 32 contacts the foundation 3 and that a gap does not form between the heat-insulating member 31 and the foundation 3. With this structure, the heat-insulating member 31 and the waterproof member 32 are simultaneously set on the exterior wall body 4A. This reduces the number of operations performed when the building 1 is constructed. Thus, the method for installing the heat-insulating waterproof structure 20 improves efficiency when the building 1 is constructed.

Modifications

The above-described embodiment exemplifies, without any intention to limit, applicable forms of the heat-insulating waterproof structure 20, the heat-insulating waterproof member 30, and the method for installing the heat-insulating waterproof structure 20. The heat-insulating waterproof structure 20, the heat-insulating waterproof member 30, and the method for installing the heat-insulating waterproof structure 20 in the above embodiment may have a different form. For example, the configuration in the above embodiment may be replaced, changed, or omitted in part or include an additional element. Modifications of the embodiment will now be described.

As long as the waterproof member 32 closes a gap between the foundation 3 and the heat-insulating member 31, the waterproof member 32 may be partially overlapped with the heat-insulating member 31 in the horizontal direction. In this case, the waterproof member 32 may contact the foundation 3, and the heat-insulating member 31 may also contact the foundation 3.

As long as the heat-insulating member 31 and the waterproof member 32 are integrated, the first portion 34 may be removed from the auxiliary member 33. When the first portion 34 is removed from the auxiliary member 33, the heat-insulating member 31 and the waterproof member 32 may be directly bonded to each other.

The second portion 35 may be removed from the auxiliary member 33.

The first portion 34 and the second portion 35 of the auxiliary member 33 do not need to be integrally formed. In the present modification, the first portion 34 and the second portion 35 may be separate flat members.

The backing 7 may be arranged on the column 6 after the first step of the method. In the present modification, in the first step, the heat-insulating waterproof member 30 is arranged on the foundation 3 so that the waterproof member 32 contacts the foundation 3 and that a gap does not form between the heat-insulating member 31 and the foundation 3.

The flashing member 12 and the heat-insulating waterproof member 30 may be fixed to the exterior wall body 4A at the same time. For example, the heat-insulating waterproof member 30 may be attached to the exterior wall body 4A by fastening the flashing member 12 with nails. In this modification, the fastening of the heat-insulating waterproof member 30 to the exterior wall body 4A with nails in the first step is omitted.

The present specification discloses the following techniques.

Clause 1

A heat-insulating waterproof structure of a building, the heat-insulating waterproof structure including:

- a heat-insulating waterproof member arranged on a building body, where
- the building body includes a foundation and an exterior wall body arranged on the foundation,
- the exterior wall body includes a metal fitting arranged on the foundation, a column set on the foundation with the metal fitting member located in between, and a backing arranged on the column, and
- the heat-insulating waterproof member includes a heat-insulating member and a waterproof member integrated with the heat-insulating member, the heat-insulating waterproof member being located at an outer side of the exterior wall body along the exterior wall body at a height where the metal fitting is located.

Clause 2

The heat-insulating waterproof structure according to clause 1, where the waterproof member is located closer to the foundation than the heat-insulating member is.

Clause 3

The heat-insulating waterproof structure according to clause 1, where the heat-insulating waterproof member includes an auxiliary member, and the auxiliary member includes a first portion that is attached to the heat-insulating member and the waterproof member and a second portion that is arranged along the heat-insulating member.

Clause 4

The heat-insulating waterproof structure according to clause 1, where the building body further includes a flashing member arranged between the foundation and the backing in a height direction, and a waterproof sheet arranged on an outer surface of the backing, the heat-insulating waterproof member is arranged below a lower surface of the backing, the flashing member is fixed to an outer surface of the heat-insulating waterproof member, and the waterproof sheet includes a lower end portion that covers an upper end portion of the flashing member.

Clause 5

The heat-insulating waterproof structure according to clause 4, where the heat-insulating waterproof member further includes a fixing member that fixes the lower end portion of the waterproof sheet to the upper end portion of the flashing member, and the fixing member includes a bonding portion bonded to the lower end portion of the waterproof sheet, the fixing member being integrated with the waterproof member and the heat-insulating member.

Clause 6

A heat-insulating waterproof member used in a heat-insulating waterproof structure of a building, the heat-insulating waterproof member including:

a heat-insulating member; and a waterproof member integrated with the heat-insulating member, where the heat-insulating member has a form of a tape and is arranged along a lower end portion of an exterior wall body of the building, and the waterproof member is arranged along a lower end of the heat-insulating member.

Clause 7

A method for installing a heat-insulating waterproof structure that is arranged on a building body, the building body including a foundation and an exterior wall body arranged on the foundation, the exterior wall body including a metal fitting arranged on the foundation, a column set on the foundation with the metal fitting located in between, and a backing arranged on the column, the method including:

providing the heat-insulating waterproof structure with a heat-insulating waterproof member, where the heat-insulating waterproof member includes a heat-insulating member and a waterproof member integrated with the heat-insulating member, and the providing the heat-insulating waterproof structure includes arranging the heat-insulating waterproof member between the foundation and a lower surface of the backing of the exterior wall body so that the waterproof member contacts the foundation without forming a gap between the heat-insulating member and the foundation.

REFERENCE SIGNS LIST

1) building, 2) building body, 3) foundation, 4A) exterior wall body, 5) metal fitting, 6) column, 7) backing, 12) flashing member, 13) waterproof sheet, 20) heat-insulating waterproof structure, 30) heat-insulating waterproof member, 31) heat-insulating member, 32) waterproof member, 33) auxiliary member, 34) first portion, 35) second portion, 36) fixing member, 37A) bonding portion

The invention claimed is:

1. A heat-insulating waterproof structure of a building, the heat-insulating waterproof structure comprising:

a heat-insulating waterproof member arranged on a building body, wherein:

the building body includes a foundation and an exterior wall body arranged on the foundation, the exterior wall body includes a metal fitting arranged on the foundation, a column set on the metal fitting, the metal fitting located between the foundation and the column, and a backing arranged on the column, the heat-insulating waterproof member includes a heat-insulating member and a waterproof member integrated with the heat-insulating member, the heat-insulating waterproof member being located at an outer side of the exterior wall body along the exterior wall body at a height where the metal fitting is located, the building body further includes:

a flashing member arranged between the foundation and the backing in a height direction; and a waterproof sheet arranged on an outer surface of the backing, the heat-insulating waterproof member is arranged below a lower surface of the backing, the flashing member is fixed to an outer surface of the heat-insulating waterproof member, and the waterproof sheet includes a lower end portion that covers an upper end portion of the flashing member.

2. The heat-insulating waterproof structure according to claim 1, wherein the waterproof member is located closer to the foundation than the heat-insulating member is.

3. The heat-insulating waterproof structure according to claim 1, wherein:

the heat-insulating waterproof member includes an auxiliary member, and the auxiliary member includes a first portion that is attached to the heat-insulating member and the waterproof member and a second portion that is arranged along the heat-insulating member.

4. The heat-insulating waterproof structure according to claim 1, wherein:

the heat-insulating waterproof member further includes a fixing member that fixes the lower end portion of the waterproof sheet to the upper end portion of the flashing member, and the fixing member includes a bonding portion bonded to the lower end portion of the waterproof sheet, the fixing member being integrated with the waterproof member and the heat-insulating member.

5. A method for installing a heat-insulating waterproof structure that is arranged on a building body, the building body including a foundation and an exterior wall body arranged on the foundation, the exterior wall body including a metal fitting arranged on the foundation, a column set on the metal fitting, the metal fitting located between the foundation and the column, and a backing arranged on the column, the method comprising:

providing the heat-insulating waterproof structure with a heat-insulating waterproof member, wherein:

the heat-insulating waterproof member includes a heat-insulating member and a waterproof member integrated with the heat-insulating member, the providing the heat-insulating waterproof structure with the heat-insulating waterproof member includes arranging the heat-insulating waterproof member between the foundation and a lower surface of the backing of the exterior wall body so that the waterproof member contacts the foundation without forming a gap between the heat-insulating member and the foundation, the building body further includes:

a flashing member arranged between the foundation and the backing in a height direction; and a waterproof sheet arranged on an outer surface of the backing, the heat-insulating waterproof member is arranged below a lower surface of the backing, the flashing member is fixed to an outer surface of the heat-insulating waterproof member, and the waterproof sheet includes a lower end portion that covers an upper end portion of the flashing member.

* * * * *